United States Patent [19]

Kubota et al.

[11] 4,124,729

[45] Nov. 7, 1978

[54] METHOD OF MULTIPLE POWDER COATING EMPLOYING GENEVA GEARS

[75] Inventors: Shigeru Kubota, Tokyo; Shoji Kano, Yokohama; Masahiro Kubo, Tokyo, all of Japan

[73] Assignee: Kishimoto Sangyo Co., Ltd., Tokyo, Japan

[21] Appl. No.: 717,617

[22] Filed: Aug. 25, 1976

[30] Foreign Application Priority Data

Sep. 12, 1975 [JP] Japan ..... 50-110619

[51] Int. Cl.[2] ..... B05C 3/09

[52] U.S. Cl. ..... 427/58; 74/84 R; 74/436; 118/423; 118/426; 427/184; 427/195; 427/201; 427/202

[58] Field of Search ..... 427/58, 185, 195, 201, 427/202, 184; 118/426, 423; 74/84 R, 436

[56] References Cited

U.S. PATENT DOCUMENTS

| | | | |
|---|---|---|---|
| 2,042,678 | 6/1936 | Miller | 118/426 |
| 2,901,378 | 8/1959 | Kempen | 118/426 |
| 3,102,043 | 8/1963 | Winthrop | 427/185 |
| 3,240,070 | 3/1966 | Martin et al. | 74/436 |
| 3,831,458 | 8/1974 | Takanashi et al. | 74/436 |
| 3,884,182 | 5/1975 | Jones | 427/185 |
| 3,901,180 | 8/1975 | Allen | 427/185 |
| 3,925,570 | 12/1975 | Reinke | 427/185 |
| 4,013,807 | 3/1977 | Putney et al. | 427/195 |

*Primary Examiner*—John D. Smith

*Attorney, Agent, or Firm*—Armstrong, Nikaido, Marmelstein & Kubovcik

[57] ABSTRACT

A method of multiple powder coating wherein articles to be coated are fed to a conveyor which comprises a pair of Geneva gears secured to both ends of a rotatable shaft. The Geneva gears have a plurality of channels around the periphery thereof for holding the articles. The gears are rotated intermittently at an interval of one channel and an article to be coated is fed to a pair of channels at every Y intermittent rotations, where Y is the number of coatings to be applied. The article is coated once in each cycle of rotation of the Geneva gears and is removed following X times Y intermittent rotations, where X is the number of channels around the periphery of each gear. X is odd when Y is even and X/Y is a decimal when Y is odd.

2 Claims, 7 Drawing Figures

METHOD OF MULTIPLE POWDER COATING EMPLOYING GENEVA GEARS

BACKGROUND OF THE INVENTION

This invention relates generally to a method for coating articles, and more particularly to a novel method for automatically applying powder coatings on various electronic parts, such as, for example, integrated circuits, condensers, diodes or the like.

It is conventional to have integrated circuits, condensers, diodes or the like coated several times with coating materials in the form of powder, such as, for example, powdered epoxide resins, to obtain electrically and physically perfect coatings without craters and pinholes to protect the surface of these parts and to provide high grade electrical insulation and anti-humidity characteristics.

In powder coating, articles to be coated are preheated prior to an application of powdered coating materials or coating surfaces are heated after the coating operation is finished. Maximum coating thickness obtainable by the powder coating at one time is approximately 200$\mu$ . If electronic parts are to be coated to a coating thickness of lmm by application of powdered coating materials in order to eliminate craters and pinholes from the coating surface and to impart sufficient electrical insulation and anti-humidity characteristics to the electronic parts, the powder coating operation must be repeated five times.

The heating and coating processes for powder coating are usually conducted automatically by a conveyer system for the sake of efficiency. One such conveyer system employs a conveyer which moves at constant speed, and another conveyer system employs a conveyer which moves intermittently at regular intervals during the heating and coating processes. This system is generally known as a tact system. The tact system is considered to be advantageous as compared with the system wherein the conveyer moves at constant speed, because the equipment for the coating operation is compact, the cost of equipment is lower, and the installation site is reduced. However, if multiple powder coatings are conducted by the tact system using a plane and linear type conveyer which includes one coating zone, the articles to be coated have to be replaced on the conveyer several times for the multiple coatings. To avoid this problem, coating zones must be set up at several locations along the path of the conveyer. Since the number of coatings varies depending upon the articles to be coated, it is preferable to make the conveyer round in order to achieve the multiple coatings using a conveyer line which includes one coating zone. Obviously, a vertically rotatable round conveyer is advantageous rather than a horizontally moveable round conveyer, because it can make good use of vertical spaces. The inventors have succeeded in providing a novel coating method using a vertically moveable, round tact conveyer system which is operated to synchronize the feeding and removal of the articles to be coated with the number of coatings applied thereto. According to the present invention, the articles to be coated are attached to the conveyer and removed therefrom every two tact rotations, or complete cycles, of the conveyer when the articles are to be coated two times. When the articles are to be coated three times, the articles are attached to the conveyer and removed therefrom every three tact rotations of the conveyer. Similarly, other multiple coating operations are conducted such that the number of tact rotations of the conveyer corresponds to the number of coating to be applied to the articles as desired.

SUMMARY OF THE INVENTION

Accordingly, one object of the present invention is to provide a novel powder coating method which can simplify the coating operation and enable multiple powder coatings to be performed with high efficiency.

Another object of the present invention is to provide a powder coating method which makes it possible to achieve multiple powder coatings using relatively inexpensive powder coating equipment which occupies a small installation space and does not cost too much to install.

The foregoing and other objects are achieved according to the present invention through the provision of a method of powder coating which comprises the steps of intermittently rotating a conveyer, feeding articles to be coated to the conveyer while it is being intermittently rotated, pre-heating the articles carried by the conveyer, applying powder coatings to the articles and then taking the articles on which the powder coatings are deposited out of the conveyer. The coating operation is repeated several times the use of a vertically rotatable round and tact conveyer system. The conveyer comprises a pair of Geneva gears which are secured to a rotating shaft of the conveyer at both ends thereof and includes a number of channels around the peripheral surfaces of the gears. The channels are arranged to have the same intervals and extend radially toward the center of the gears. The articles to be coated are put into the channels and are carried by the conveyer during the entire coating process except when the powder coatings are applied to the article.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein.

DETAILED DESCRIPTION OF PREFERRED EMBODIMENTS

Figure 1:
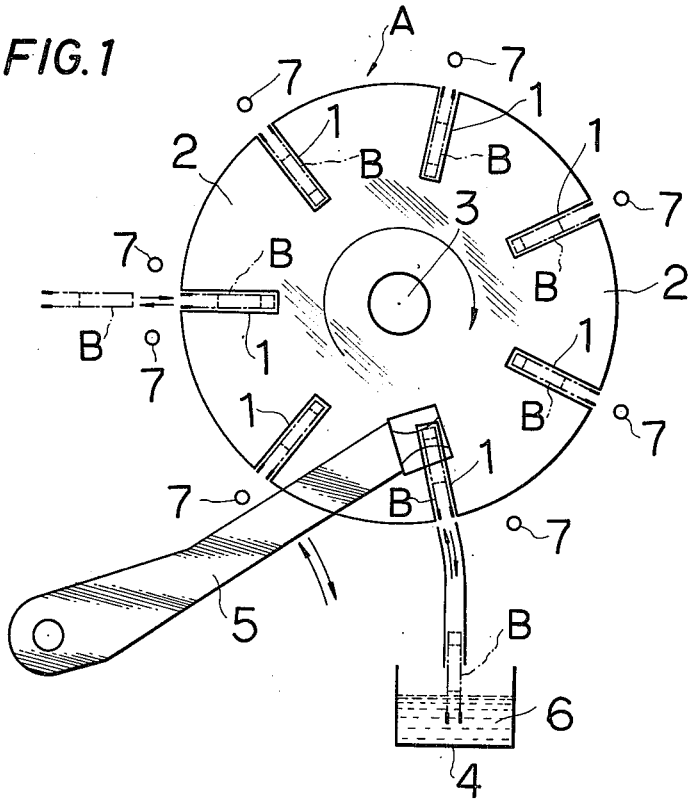
FIG. 1 is a schematic side view of an apparatus to be utilized in a method of powder coating in accordance with the present invention.
Figure 2:
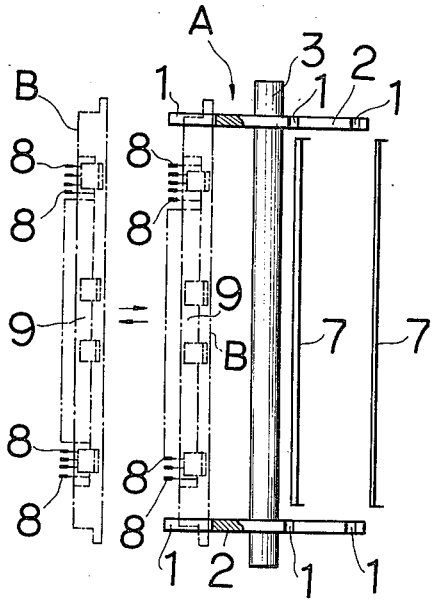
FIG. 2 is a cross-sectional plane view of the powder coating apparatus shown in FIG. 1 wherein articles to be supplied to the coating apparatus are indicated on the left side.

Referring now to FIG. 1, the primary portion of an apparatus for practicing the method of the present invention is illustrated, and comprises basically a conveyer made of a pair of Geneva gears as hereinafter described in detail. The conveyer A is formed of a pair of Geneva gears 2 each in the form of disc having a certain number of channels 1 around the peripheral surface thereof. The channels 1 are arranged on the disc to have regular intervals extending radially toward the center of the discs. The Geneva gears 2 are secured to both ends of a rotating shaft 3 which is supported by a frame (not shown) and causes the conveyer A to rotate intermittently corresponding to the pitches of the channels 1. A batch 4 containing powder coating material 6 is disposed below the conveyer A and a lever 5 is provided between the conveyer A and the batch 4. Electric heaters 7 are arranged around the conveyer A at positions facing the channels 1 of the Geneva gears 2.

Figure 3:
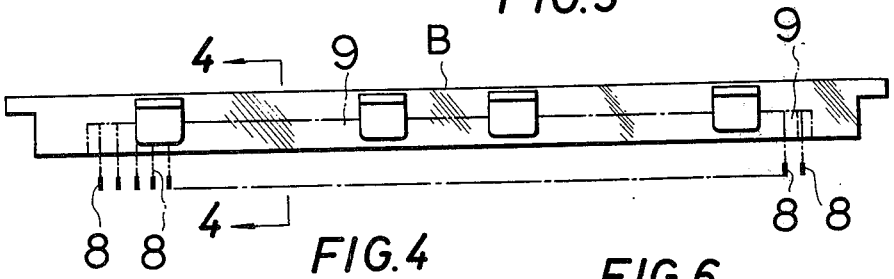
FIG. 3 is a plan view of a holder for supporting the articles to be coated and for supplying the articles to the coating apparatus.
Figure 4:
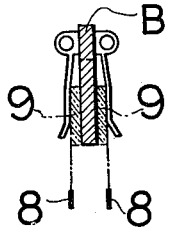
FIG. 4 is an enlarged cross-sectional view taken along the line 4—4 of FIG. 3.
Figure 6:
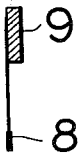
FIG. 6 is an enlarged cross-sectional view taken along the line 6—6 of FIG. 5.
Figure 5:
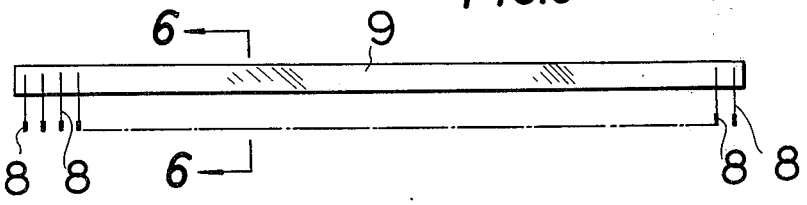
FIG. 5 is a plan view of a fixing plate for the articles to be coated and which is pinched by the holder shown in FIG. 3.

Articles 8 to be coated (such as, for example, integrated circuits, condensers, diodes or the like) are adhered to a plate 9 by an adhesive tape as shown in FIG. 5, and the plate 9 is pinched by clips provided on a holder B at both sides thereof as shown in FIGS. 3 and 4. The holder B carrying a plurality of electronic parts to be coated is supplied to a channel 1 on the Geneva gears 2 of the conveyer A by a manually or electrically actuated lever (not shown). Also, the electronic parts after having the powder coatings, desposited thereon are taken out of the channel 1 by the lever.

A coating operation according to the present invention may be carried out by: supplying the holders B to which the articles 8 to be coated are attached to a channel 1 on the Geneva gears 2 of the conveyer A which are intermittently rotated at an interval of one channel 1; pre-heating the articles 8 to be coated by the heaters 7 while the conveyer A is intermittently rotated; depositing the powder coatings on the articles 8 by dipping them into the powder coating material 6 contained in the batch 4 by actuation of the lever 5; and removing the coated articles from channel 1 mannually or by a lever when the articles on which the powder coatings have been deposited return at this point, one cycle of rotation of the conveyer A is finished.

However, a powder coating is deposited on the articles only one time by the above one cycle rotation of the conveyer A. In order to coat the articles 8 two or more times, for example three times, the single cycle rotation of the conveyer must be repeated three times in the following manner. In the first cycle, the articles 8 to be coated are supplied to each channel 1. In the second cycle, the feeding operation of the articles 8 to be coated is omitted. Upon completion of the third cycle, the coated articles are removed from the channels 1 and new articles 8 to be coated must be inserted in each channel 1 simultaneously with the of the coated articles. This discontinuous and random feeding and removing of the articles is not advisable in view of efficiency.

The multiple coating method according to the present invention eliminates the disadvantages as described hereinabove by supplying the articles to be coated to the channels 1 in a particular sequence depending upon the desired number of coatings to thereby enhance the efficiency of the feeding and removing operations of the articles. The operation of the multiple coating method in accordance with the present invention is hereinafter described in detail.

In the drawings, there is shown a conveyer A made of Geneva gears 2 having seven channels C1 to C7. Thus, the explanation as to the multiple coating method will be made with reference to the conveyer shown in the drawings.

The number of channels 1 provided on the Geneva gears 2 of the conveyer A may be an odd or even number. A conveyer having an odd number of the channels 1 is preferred because a conveyer having an even number of channels may require some modification in use.

Supposing that the number of channels is X and the number of coatings to be aplied is Y, the following relationships.

Y=2 . . . X must be an odd number.

Y=3 . . . X may be either and odd or even number. However X/Y must be a decimal.

Y=4 . . . X must be an odd number.

Y=5 . . . X may be either an odd or even number. However X/Y must be a decimal.

In the same way, when Y is more than 5, the conditions which satisfy the requirements as explained hereinabove must be selected. When X is less than 10 and Y is 2 to 6, it is preferable to make X seven in view of the foregoing conditions.

When the articles 8 are to be coated two times, the articles are supplied to the channels 1 of the conveyer A, which is rotated at an interval of one channel, at every 2/7 intermittent rotations of the conveyer A from the location S. In other words, the articles are supplied at every two channels.

In the same way, when the articles 8 are to be coated three times, they are supplied to the channels 1 at every 3/7 intermittent rotations of the conveyer S.

During the intermittent rotations of the conveyer A at intervals of one channel (rotation of one cycle of the conveyer), the powder coatings are applied to the articles 8 by the actuation of the lever 5. The actuation of lever 5 is synchronized with the intermittent rotations of the conveyer irrespective of the presence or absence of the articles in the channels 1 of the conveyer, and removes the articles from a channel and immerse them in a bed of coating materials in the batch 4. When the channel comes the working area of the lever 5. After the coatings are deposited on the articles, the articles are returned to the channel by the lever 5. This operation is carried out while the conveyer A is temporarily stopped during the intermittent rotations. The conveyer A is rotated several cycles depending upon the number of coatings desired.

Figure 7:
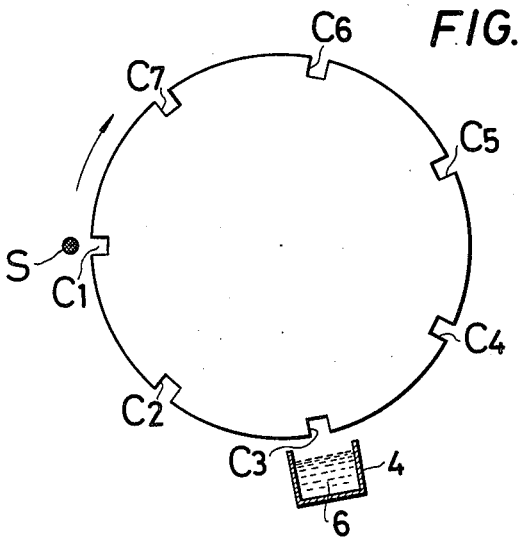
FIG. 7 is a schematic side view of the coating apparatus illustrating multiple coating operations in accordance with the present invention.

In order to more fully appreciate the multiple coating method of the present invention, a description will be hereinafter made as to a method for applying three powder coatings with reference to FIG. 7 by way of an example.

A channel C1 of Geneva gears 2 is position at the starting point S and the first articles to be coated are supplied to the channel C1. The Geneva gears 8 are intermittently rotated at the intervals of one channel, and the second articles to be coated are supplied to the channel C4 when it reaches the starting point S. In the same way, the third articles to be coated are supplied to the channel C7. When the first articles inserted into the channel C1 pass the starting point S, the rotation of one cycle of the first articles is completed. The articles are coated with the powder coatings one time when the articles come to the position of the coating batch 4 during this cycle.

When the first articles start the second cycle of rotation and the channel C3 reaches the starting point S, the fourth articles are inserted into the channel C3. During this cycle, the second articles are coated with the powder coatings one time. When the second articles pass the starting point S and the channel C6 reaches the starting point S, the fifth articles are supplied to the channel C6. During this cycle, the third articles are coated with the powder coating one time. At the same time, the first articles in the channel C1 are coated a second time. When the first articles begin the third cycle of rotation and the channel C2 reaches the starting point S, the sixth articles are supplied to the channel C2. During this cycle, the second articles in the channel C4 are coated a second time. When the second articles move beyond the starting point S and the channel C5 reaches the starting point S, the seventh articles are supplied to the channel C5. During this cycle, the third articles 3 in the channel C7 are coated a second time. At the same time, the articles in the channel C1 are coated a third time. When the channel C1 reaches the starting point S after the completion of twenty one intermittent rotations of the Geneva gears 2, the first articles have completed three cycles and are taken out of the channel C1 manually or by the lever. Then, new articles to be coated are supplied to the channel C1. During this cycle of rotation, the fourth articles in the channel 3 are coated a first time.

As explained hereinabove, the articles to be coated and which supplied to each of channels C1 to C7 of the Geneva gears are coated three times during the three cycles of rotation of the conveyer for the articles in each channel. When a channel supporting articles which have been coated three times reaches the starting point, the coated articles are removed from the channel and replaced by new articles to be coated so as to continue the coating operation.

According to the present invention, a desired number of coatings can be applied to articles by the intermittent rotations of the conveyer A, the number of intermittent rotations of the articles being calculated by multiplying the number of channels provided on the Geneva gears by the number of coatings desired. In other words, when the number of channels is seven and the articles are desired to be coated three times, the conveyer (and, consequently, the articles in any given channel) is rotated intermittently twenty one times. Similarly, when the number of channels is five and the articles are desired to be coated two times, the conveyer is rotated intermittently ten times.

Obviously, many modifications and variations of the present invention are possible in light of the above teachings. It is to be understood, therefore, that within the scope of the appended claims, the invention may be practiced otherwise than as specifically described herein.

What is claimed as new and deserved to be secured by Letter Patent of the United States is:

1. A method of multiple powder coating comprising the steps of feeding articles to be coated to a conveyer which comprises a pair of Geneva gears secured to both ends of a rotating shaft of said conveyer, said Geneva gears having a plurality of channels around the peripheral surfaces thereof and said articles being held in said channels, said articles being fed intermittently to said channels at every Y intermittent rotations of said Geneva gears; rotating said conveyer intermittently at an interval of one channel, the total number of intermittent rotations for each of said articles being equal to X times Y, where X is the number of channels around the peripheral surface of each of said Geneva gears and Y is the number of coatings to be applied to said articles, X being an odd number when Y is an even number and X/Y being a decimal number when Y is an odd number; heating said articles to be coated by electric heaters provided around said conveyer during the intermittent rotations of said conveyer; applying powder coatings in a batch provided below said conveyer to each article once in each cycle of the rotations of said conveyer; and removing each of said articles from said gears after X times Y intermittent rotations thereof.

2. A method of multiple powder coating as set forth in claim 1, wherein the powder coatings are applied to said article by actuation of a lever which synchronizes with the intermittent rotation of said conveyer.

* * * * *